US007060907B2

(12) United States Patent
Maeda

(10) Patent No.: US 7,060,907 B2
(45) **Date of Patent: *Jun. 13, 2006**

(54) ELECTRIC WIRE FOR AUTOMOBILE

(75) Inventor: Koutarou Maeda, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/959,126

(22) Filed: Oct. 7, 2004

(65) Prior Publication Data

US 2006/0011378 A1 Jan. 19, 2006

(30) Foreign Application Priority Data

Jul. 15, 2004 (JP) ..... 2004-208110
Jul. 15, 2004 (JP) ..... 2004-208272

(51) Int. Cl.
*H01B 5/08* (2006.01)

(52) U.S. Cl. ..... 174/128.1

(58) Field of Classification Search ..... 174/128.1, 174/128.2, 126.1
See application file for complete search history.

(56) References Cited

U.S. PATENT DOCUMENTS 6,137,060 A * 10/2000 Avellanet ..... 174/128.1
6,674,011 B1 * 1/2004 Ueno et al. ..... 174/128.1
6,900,391 B1 * 5/2005 Maeda ..... 174/128.1
2005/0109530 A1 * 5/2005 Maeda ..... 174/128.1

FOREIGN PATENT DOCUMENTS

EP 0 331 182 * 4/1994
JP A 1-225006 9/1989

* cited by examiner

*Primary Examiner*—Chau N. Nguyen
(74) *Attorney, Agent, or Firm*—Oliff & Berridge, PLC

(57) ABSTRACT

An electric wire for automobile including a compressed conductor which is obtained by arranging, around a single central element wire of stainless steel, a plurality of peripheral element wires of copper or copper alloy in a single circle in tight adherence with each other, wherein the cross sectional area of the conductor is 0.10 through 0.30 $mm^2$, and a ratio C of the cross sectional area of the central element wire to the cross sectional area of the conductor expressed by the formula below is 19.6 through 33.3%: the ratio C of the cross sectional area of the central element wire to the cross sectional area of the conductor being A/(A+B)}×100 [%], wherein the symbol A denotes the cross sectional area of the central element wire and the symbol B denotes the total cross sectional area of the peripheral element wires; or the diameter of the central element wire is larger than the diameters of the peripheral element wires, and the compression rate from the cross sectional area of the conductor before compression to the cross sectional area of the conductor after compression is 5 through 20%.

8 Claims, 4 Drawing Sheets

ELECTRIC WIRE FOR AUTOMOBILE

CROSS REFERENCE TO RELATED APPLICATION

The invention claims priority to Japanese Patent Application Nos. 2004-208110 and 2004-208272, both filed on Jul. 15, 2004. The disclosures of the prior applications are incorporated herein by reference in their entirety.

BACKGROUND OF THE INVENTION

1. Field of Invention

The present invention relates to an electric wire for automobile. More particularly, it relates to an electric wire for automobile which meets the demand for an improved tensile strength and a smaller diameter.

2. Description of Related Art

An automobile uses a wire harness, which is a bundle of many electric wires, for electric connection with electrical equipment. Some of electric wires used in a wire harness comprise conductors having a twisted wire structure, which is obtained by twisting a plurality of element wires. FIG. 1 shows a typical conductor (element wire aggregate) included in this type of wire. In FIG. 1, denoted at 1 is the conductor having a twisted wire structure in which six peripheral element wires 3 are arranged around a single central element wire 2 like a single circle in tight adherence with each other and twisted. So far, in general, copper or copper alloy has been used as the central element wire 2 and the peripheral element wires 3 which form the conductor in such a twisted wire structure. Further, the diameters of the central element wire 2 and the peripheral element wires 3 are customarily the same. As a further general aspect, the nominal cross sectional area of the conductor is approximately 0.35 $mm^2$ for use within a car room and approximately 0.50 $mm^2$ for use within an engine room.

Meanwhile, the recent years have seen an increasing demand to an electric wire for automobile for an improved tensile strength and a smaller diameter. However, in the case of the electric wire shown in FIG. 1, it is necessary to increase the diameter of the conductor to improve in tensile strength, which contradicts the demand for a smaller diameter.

In light of this, an object of the present invention is to provide an electric wire for automobile which realizes a better tensile strength when the diameter of a conductor remains unchanged, maintains a tensile strength comparable to that of a conventional electric wire for automobile even when the diameter of the conductor is reduced, and achieves an equally favorable or better tensile strength than that of a conventional electric wire for automobile depending upon how thin the diameter of the conductor has been reduced.

As a result of intensive researches, it is possible to improve a tensile strength when stainless steel is used as a central element wire, and with an appropriate relationship satisfied between the cross sectional area of the central element wire and that of a conductor, it is possible to meet the demand for a smaller diameter which has been met almost to a limit and nevertheless ensure a tensile strength while preventing bending fracture.

Furthermore, when the diameter of the central element wire is made larger than the diameters of peripheral element wires, a compressed conductor is used as the conductor and the compression rate from the cross sectional area of the compressed conductor before compression to the cross sectional area after compression is within a proper range, it is possible to better meet the demand for a smaller diameter, solve the problem of heat generation as the peripheral element wires break before the central element wire does, and maintain an excellent impact breaking load.

SUMMARY OF THE INVENTION

Various exemplary embodiments of the invention are directed to an electric wire for automobile having a compressed conductor which is obtained by arranging, around a single central element wire of stainless steel, a plurality of peripheral element wires of copper or copper alloy in a single circle in tight adherence with each other, wherein the cross sectional area of the conductor is 0.10 through 0.30 $mm^2$, and a ratio C of the cross sectional area of the central element wire to the cross sectional area of the conductor expressed by the formula below is 19.6 through 33.3%:

The ratio C of the cross sectional area of the central element wire to the cross sectional area of the conductor being $A/(A+B)\}\times 100[\%]$, wherein the symbol A denotes the cross sectional area of the central element wire and the symbol B denotes the total cross sectional area of the peripheral element wires.

Various exemplary embodiments of the invention are directed to an electric wire for automobile having a compressed conductor which is obtained by arranging, around a single central element wire of stainless steel, seven or more peripheral element wires of copper or copper alloy in a single circle in tight adherence with each other, wherein the diameter of the central element wire is larger than the diameters of the peripheral element wires, the cross sectional area of the conductor is 0.10 through 0.30 $mm^2$, and the compression rate from the cross sectional area of the conductor before compression to the cross sectional area of said conductor after compression is 5 through 20%.

BRIEF DESCRIPTION OF THE DRAWINGS

The accompanying drawings, which are incorporated with and constitute a part of the specification, illustrate one or more embodiments of the invention, and taken with the detailed description, serve to explain the principles and implementations of the invention. In the drawings.

DETAILED DESCRIPTION OF EXEMPLARY EMBODIMENTS

Figure 1:
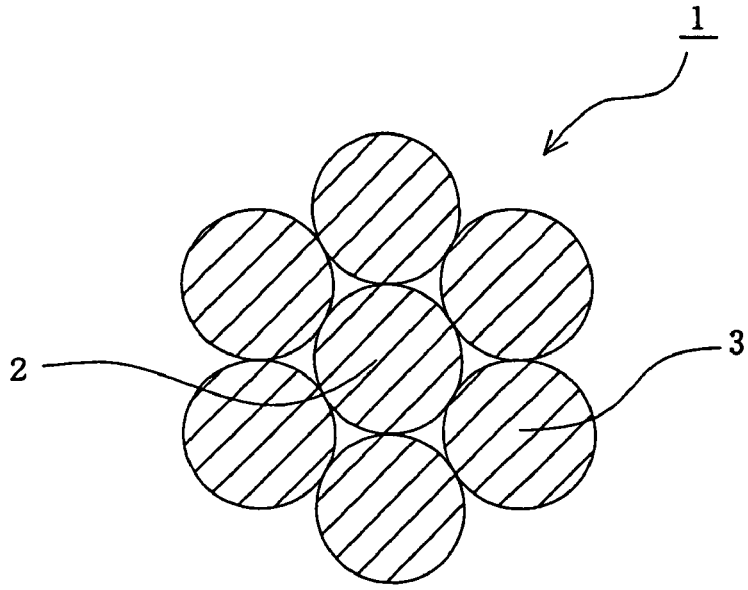
Fig. 1 (Related Art)
FIG. 1 is a cross sectional view of an electric wire for automobile having a conventional twisted wire structure (non-compressed conductor).

According to various exemplary embodiments of the invention, because stainless steel is used as a central element wire, it is possible to obtain a better tensile strength than that of a conventional electric wire, which uses copper or copper alloy for this purpose.

Further, because a compressed conductor is used as a conductor, which is includes the central element wire and peripheral element wires, it is possible to efficiently reduce the diameter of the conductor.

When the cross sectional area of the conductor is too small, it is not possible to attain a sufficient tensile strength despite use of stainless steel as the central element wire, while when the cross sectional area is too large, it is not possible to meet the demand for a smaller diameter, and rather, the flexibility may deteriorate. Considering this, the cross sectional area of the conductor is preferably 0.10 through 0.30 $mm^2$.

According to the invention, because a ratio C of the cross sectional area of the central element wire to the cross sectional area of the conductor is 19.6% or higher or the diameter of the central element wire is larger than the diameters of the peripheral element wires, an electric wire including a conductor whose cross sectional area is 0.10 through 0.30 $mm^2$ has a satisfactory tensile strength. In addition, various exemplary embodiments of the invention which demands that the ratio C is 19.6% or higher achieves a desired tensile strength at a terminal fixing portion of the electric wire for automobile, which is important (hereinafter referred to as "terminal fixing power").

When the ratio C of the cross sectional area of the central element wire to the cross sectional area of the conductor is too high, the flexibility deteriorates. However, with the ratio C set to 33.3% or lower, bending fracture is unlikely and satisfactory flexibility is obtained.

Even when the demand for an improved tensile strength of the conductor and a smaller diameter is met, use of stainless steel as the central element wire leads to a new problem. This problem becomes apparent particularly when the diameter of the central element wire is larger than the diameters of the peripheral element wires.

The problem is that, when an excessively large stress upon the electric wire breaks the peripheral element wires of copper or copper alloy whose conductivity is high before breaking the central element wire of stainless steel whose conductivity is low, the central element wire may generate heat and a safety problem may thus occur. It is therefore desirable that the central element wire gets ruptured before the peripheral element wires do even in the presence of excessive stress.

Endeavors to meet this have arrived at findings that the compression rate from the cross sectional area of the conductor before compression to the cross sectional area of the conductor after compression is important, and it has been found through experiments that the range mentioned earlier, namely the compression rate needs be 5% or more.

When the cross sectional area of the conductor is within this range, the central element wire breaks before the peripheral element wires do even in the presence of large stress upon the conductor while a predetermine tensile strength is attained. Thus, the electric wire is highly reliable and will not invite the heat generation problem.

Meanwhile, an excessively high compression rate reduces an impact breaking load. It has been found that in the case of an electric wire for automobile in which the cross sectional area of the conductor is within the range above, when the compression rate is 20% or lower, it is possible to achieve the impact breaking load of 5 N or more which is a required level. Compression of the conductor is preferably carried out by using compression dies.

Further, according to various exemplary embodiments of the invention, because the peripheral element wires are arranged in a single circle around the central element wire, the peripheral element wires are arranged stably relative to the central element wire.

The electric wire will not survive a large impact load when the diameter of the conductor is reduced almost to a limit, whereas when diameter reduction is not sufficient, it is not possible to use enough number of electric wires needed in a current automobile becoming increasingly electronized. In light of these factors, a practical and desirable cross sectional area of the conductor is 0.13 through 0.25 $mm^2$ both in the case of the invention of claim 1 and of the invention of claim 2. In various preferred exemplary embodiments, the cross sectional area of the conductor is 0.13 through 0.25 $mm^2$, and the ratio C of the cross sectional area of the central element wire to the cross sectional area of the conductor is 19.6 through 29.1%.

Various exemplary embodiments of the invention are directed to the electric wire for automobile, wherein the cross sectional area of the conductor is 0.13 through 0.25 $mm^2$, and the ratio C of the cross sectional area of the central element wire to the cross sectional area of the conductor is 19.6 through 29.1%.

Various exemplary embodiments of the invention are directed to the electric wire for automobile, wherein the cross sectional area of the conductor is 0.13 through 0.25 $mm^2$.

In the event that diameter reduction is maximum while considering a tensile strength, an impact load and flexibility, the most practical and desirable cross sectional area of the conductor for use within a car room is the nominal cross sectional area of 0.13 $mm^2$. In various preferred exemplary embodiments, the cross sectional area of the conductor is 0.13 $mm^2$, and the ratio C of the cross sectional area of the central element wire to the cross sectional area of the conductor is 24.5 through 29.1%.

Various exemplary embodiments of the invention are directed to the electric wire for automobile, wherein the cross sectional area of the conductor is the nominal cross sectional area of 0.13 $mm^2$, the ratio C of the cross sectional area of the central element wire to the cross sectional area of the conductor is 24.5 through 29.1%, and the electric wire is used within a car room.

Various exemplary embodiments of the invention are directed to the electric wire for automobile, wherein the nominal cross sectional area of the conductor is 0.13 $mm^2$, and the electric wire is used within a car room.

In the event that diameter reduction is maximum while considering a tensile strength, an impact load and flexibility like the above, the most practical and desirable cross sectional area of the conductor for use within an engine room is the nominal cross sectional area of 0.22 $mm^2$. In various preferred exemplary embodiments, the cross sectional area of the conductor is 0.22 $mm^2$, and the ratio C of the cross sectional area of the central element wire to the cross sectional area of the conductor is 24.5 through 29.1%.

Various exemplary embodiments of the invention in claim 7 are directed to the electric wire for automobile, wherein the nominal cross sectional area of the conductor is 0.22 $mm^2$, the ratio C of the cross sectional area of the central element wire to the cross sectional area of the conductor is 24.5 through 29.1% and the electric wire is used within an engine room.

Various exemplary embodiments of the invention are directed to the electric wire for automobile, wherein the nominal cross sectional area of the conductor is 0.22 $mm^2$, and the electric wire is used within an engine room.

Figure 2:
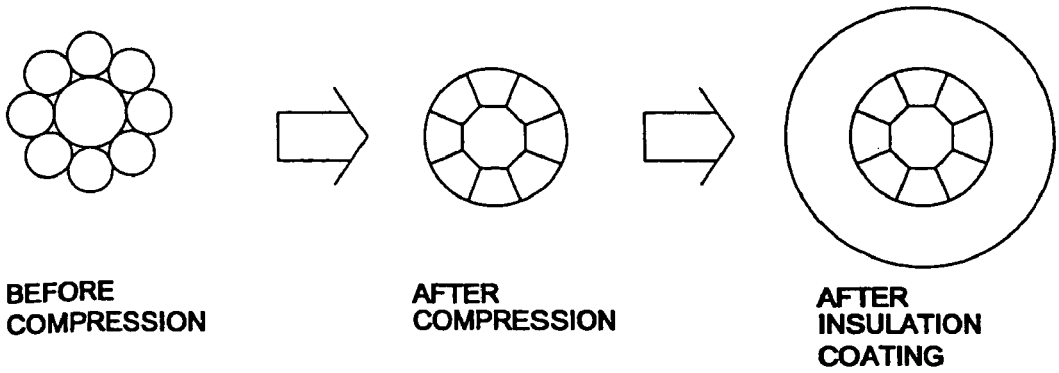
FIG. 2 is cross sectional views which show the state before compression, the state after compression and the state after insulation coating of an example of electric wire for automobile according to the present invention.
Figure 3:
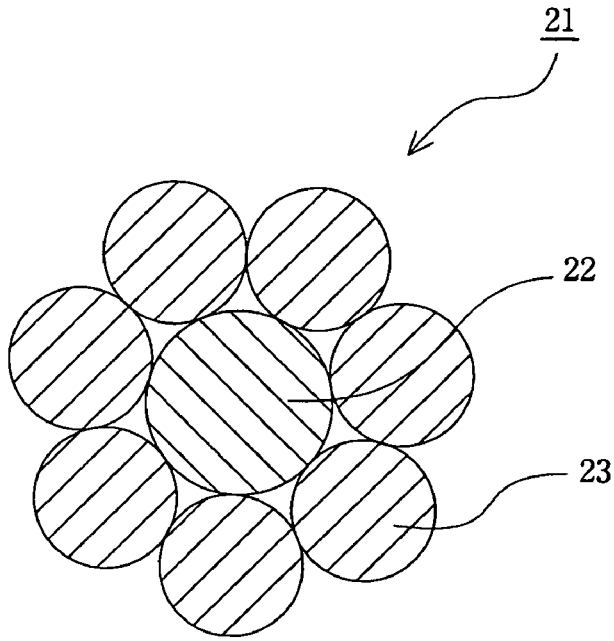
FIG. 3 is a cross sectional view which shows the state of the electric wire for automobile according to the present invention before compression.

FIG. 2 is a cross sectional view showing the state of the conductor before compression, after compression and after insulation coating of an electric wire for automobile according to various exemplary embodiments of the invention, and showing an example of structure that eight peripheral element wires are used. FIG. 3 is a cross sectional view showing the state of the conductor before compression, and showing an example of structure that seven peripheral element wires are used.

In FIG. 3, denoted at 21 is the conductor before compression (element wire aggregate) having a twisted wire structure that around a single central element wire 22 of stainless steel, seven peripheral element wires 23 of copper or copper alloy are arranged in a single circle in tight adherence with each other and twisted together. The cross sectional area of the central element wire 22 is set to satisfy a predetermined relationship with that of the conductor 21. Alternatively, the diameter of the central element wire 22 is set larger than the diameters of the peripheral element wires 23. Using compression dies or the like for instance, such an element wire aggregate is compressed in the directions toward the center and turned into a compressed conductor. An insulation coating is disposed around the compressed conductor directly or through a shield layer, thereby obtaining an electric wire for automobile.

While the conventional electric wire for automobile shown in FIG. 1 has a structure that six peripheral element wires are arranged in a single circle in tight adherence with each other around the central element wire, in the electric wire for automobile in various exemplary embodiments of the invention, in order to set the cross sectional area of the central element wire to satisfy the predetermined relationship with that of the conductor, the number of the peripheral element wires is preferably seven or more.

When the diameter of the central element wire is larger than the diameters of the peripheral element wires, the number of the peripheral element wires is 7 or more. In this case, although the number of the peripheral element wires may be any desired number as long as there are seven or more peripheral element wires, the number of the peripheral element wires is more preferably 7 through 10, and particularly preferably 8, from a standpoint of productivity.

While various types of stainless steel may be used as the central element wire of the electric wire for automobile according various exemplary embodiments of to the invention, it is desirable to use SUS 304, SUS 316 (both defined in Japanese Industrial Standards) or the like which exhibit particularly large tensile strengths.

Further, while various types of copper or copper alloy may be used as the peripheral element wires, considering conductivity, tensile strength, elongation, etc., it is desirable to use pure copper, Cu—Ni—Si alloy, Cu—Sn alloy, Cu—Cr—Zr alloy or the like.

Considering use of the electric wire for automobile according to various exemplary embodiments of the invention as an electric wire for wire harness, the tensile breaking load of the conductor is preferably 62.5 N or more for use within a car room, and preferably 100 N or more for use within an engine room. Meanwhile, the terminal fixing power is preferably 50 N or more for use within a car room and preferably 70 N or more for use within an engine room.

Next, in an effort to identify an appropriate range of the ratio C of the cross sectional area of the central element wire to the cross sectional area of the conductor, the tensile breaking load, the terminal fixing power and the bending fracture count of the conductor were measured under various conditions.

In the experiment, SUS 304 having the tensile fracture strength of 940 MPa was used as the central element wire, pure copper having the tensile fracture strength of 230 MPa was used as the peripheral element wires, and the conductor compressed at the compression rate of 10 through 15% was used.

As for the terminal fixing power, after caulking with a terminal and accordingly fixing the conductor such that the conductor will not fall out, the terminal may be fixed, the other end of the terminal of the conductor may be pulled, and the tensile breaking load at the time of breaking of the conductor at the terminal fixing portion may be measured.

Figure 4:
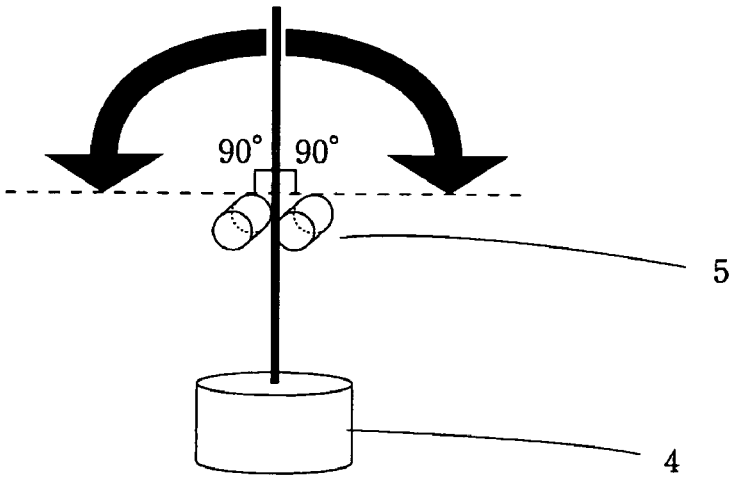
FIG. 4 is a conceptual view which shows how a bending test is conducted.

The bending fracture test has been shown to be as follows:

A sash weight 4 having the weight of 500 g was attached to the bottom end of the conductor as shown in FIG. 4 inside a constant temperature bath which was at 23° C., the conductor was held between cylindrical mandrels 5 having R=6 mm, and the bending frequency until the conductor has fractured was measured on the condition that one round trip was the bending frequency of 1 while bending the conductor to the left-hand side at 90 degrees and then to the right-hand side at 90 degrees along the outer circumferences of the mandrels 5.

Table 1 shows the test result.

TABLE 1

| The cross sectional area of the conductor ($mm^2$) | The number of the peripheral element wires | The cross sectional area of the central element wire ($mm^2$) | Ratio C (%) | Tensile breaking load (N) | Terminal fixing power of the terminal (N) | Bending fracture count of the conductor |
|---|---|---|---|---|---|---|
| 0.10 | 7 | 0.0196 | 19.6 | 41 | 32.6 | 1855 |
| 0.14 | 6 | 0.0200 | 14.3 | 51 | 40.8 | 1989 |
| 0.14 | 7 | 0.0274 | 19.6 | 57 | 45.6 | 1146 |
| 0.14 | 8 | 0.0343 | 24.5 | 63 | 50.4 | 878 |
| 0.14 | 9 | 0.0407 | 29.1 | 70 | 56.0 | 649 |
| 0.14 | 10 | 0.0466 | 33.3 | 74 | 59.2 | 455 |
| 0.14 | 11 | 0.0519 | 37.1 | 79 | 63.2 | 365 |
| 0.14 | 12 | 0.0568 | 40.6 | 83 | 66.4 | 288 |
| 0.25 | 7 | 0.0490 | 19.6 | 102 | 71.3 | 397 |

TABLE 1-continued

| The cross sectional area of the conductor ($mm^2$) | The number of the peripheral element wires | The cross sectional area of the central element wire ($mm^2$) | Ratio C (%) | Tensile breaking load (N) | Terminal fixing power of the terminal (N) | Bending fracture count of the conductor |
|---|---|---|---|---|---|---|
| 0.25 | 8 | 0.0613 | 24.5 | 113 | 78.8 | 252 |
| 0.25 | 9 | 0.0728 | 29.1 | 125 | 87.5 | 159 |
| 0.30 | 8 | 0.0735 | 24.5 | 135 | 94.5 | 155 |
| 0.30 | 10 | 0.0999 | 33.3 | 159 | 111.0 | 66 |

Table 1 thus indicates that when the cross sectional area is 0.14 $mm^2$, it is necessary that the ratio C is 24.5% or higher in order to realize the tensile breaking load of 62.5 N, and the terminal fixing power of 50 N which are preferred for use within an automobile.

On the other hand, when the cross sectional area is 0.25 $mm^2$, the ratio C needs be 19.6% or higher in order to realize the tensile breaking load of 100 N, and the terminal fixing power of 70 N which are preferred for use within an engine room.

The bending fracture count of the conductor is preferably 150 or higher and more preferably 250 or higher, and for this count to be attained or surpassed, the ratio C needs be 40.6% when the cross sectional area is 0.14 $mm^2$ and 24.5% or lower when the cross sectional area is 0.25 $mm^2$.

An insulation coating is disposed around a conductor of an electric wire for automobile manufactured as a final product, and various types of conventional resin materials, such as polyvinyl chloride (PVC), polyethylene (including foam polyethylene), halogen-free materials and tetrafluoroethylene, may be used as the insulation coating. The thickness of the insulation coating is appropriately set in accordance with the final outer diameter of the conductor.

Further, in the event that a shield layer is to be disposed, various types of known materials, which are effective as shields, may be used.

Examples of the invention will now be described. The invention however is not limited to the following examples. The examples below may be modified in various manners to the same and equivalent extent as various exemplary embodiments of the invention.

EXAMPLE 1

SUS 304 having the cross sectional area of 0.0314 $mm^2$ and the tensile fracture strength of 957 MPa was used as a central element wire before compression, and pure copper having the cross sectional area of 0.1321 $mm^2$ and the tensile fracture strength of 240 MPa was used as peripheral element wires before compression. Seven such peripheral element wires were arranged in a single circle in tight adherence with each other around the central element wire, they were compressed using dies and then coated by extrusion with an insulation coating material which was a halogen-free material (olefin based), whereby the electric wire for automobile according to the invention was obtained.

The cross sectional area of the central element wire of thus obtained electric wire was 0.0274 $mm^2$, the cross sectional area of the conductor was 0.14 $mm^2$, and the ratio C of the cross sectional area of the central element wire to the cross sectional area of the conductor was 19.6%. The tensile breaking load was 59 N, the terminal fixing power was 47 N, and the bending fracture count was 1186.

EXAMPLE 2

SUS 304 having the cross sectional area of 0.0398 $mm^2$, and the tensile fracture strength of 949 MPa was used as a central element wire before compression. Pure copper having the cross sectional area of 0.1231 $mm^2$, and the tensile fracture strength of 245 MPa was used as peripheral element wires before compression. Eight such peripheral element wires were arranged in a single circle in tight adherence with each other around the central element wire. They were compressed using dies and then coated by extrusion with an insulation coating material, which was a halogen-free material (olefin based), whereby the electric wire for automobile according to the invention was obtained. The cross sectional area of the central element of thus obtained electric wire was 0.0343 $mm^2$, the cross sectional area of the conductor was 0.14 $mm^2$, and the ratio C of the cross sectional area of the central element wire to the cross sectional area of the conductor was 24.5%. The tensile breaking load was 65 N, the terminal fixing power was 52 N, and the bending fracture count was 906.

A description will now be given on an example that the compression rate from the cross sectional area of the conductor before compression to the cross sectional area of the conductor after compression is set to 5% or higher, in order to obtain a reliable electric wire which does not cause the problem of heat generation as the central element wire breaks before peripheral element wires do even in the presence of large stress upon the conductor while a predetermine tensile strength is attained.

Figure 5:
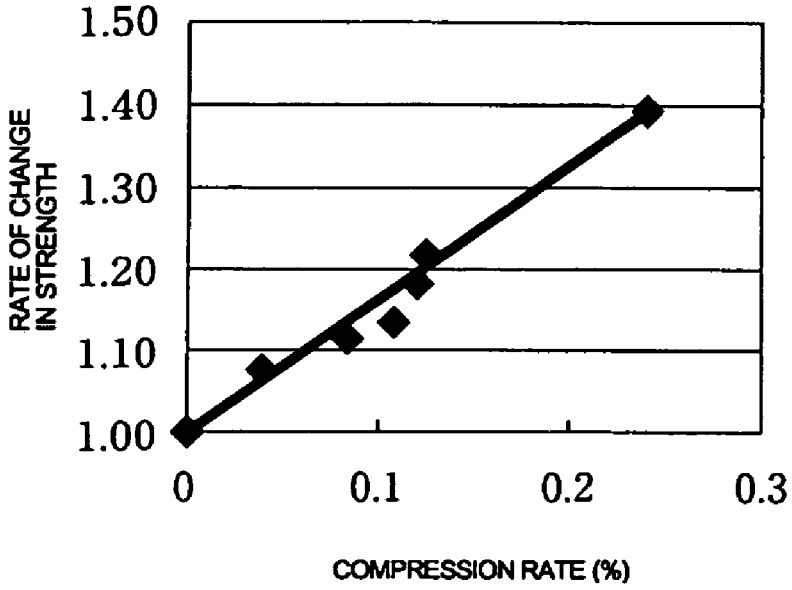
FIG. 5 is a graph which shows a relationship between the compression rate and the rate of change in tensile strength of a stainless steel wire.

First, a relationship between the compression rate and the rate of change in tensile strength of a stainless steel wire which was used as the central element wire was identified. The same trend was observed while the wire diameter and the material were changed. FIG. 5 shows the test result, which was obtained when SUS 304 having the diameter of 0.225 mm was used.

From FIG. 5, it is seen that as the compression rate increases, the rate of change in tensile strength increases in proportion within the area shown in FIG. 4.

Figure 6:
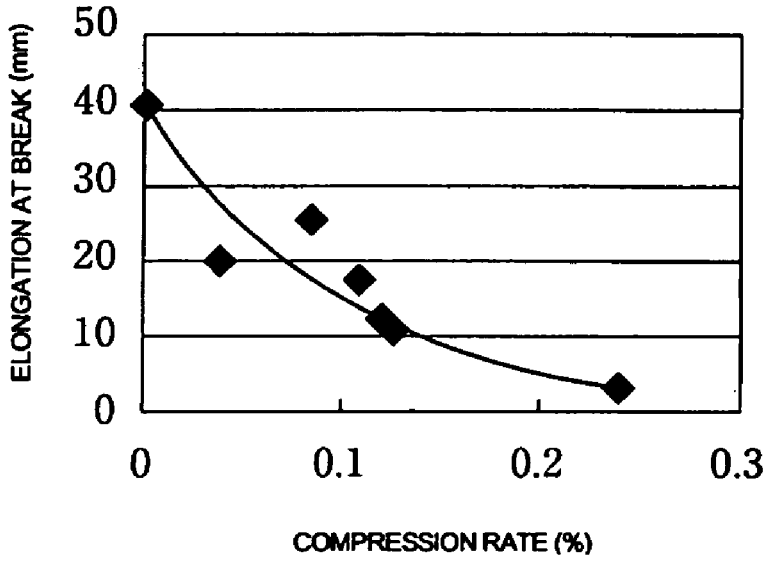
FIG. 6 is a graph which shows a relationship between the compression rate and the elongation at break of a stainless steel wire.

Next, a relationship between the compression rate and the elongation at break of a stainless steel wire was identified. The same trend was observed while the wire diameter and the material were changed. FIG. 6 shows the test result, which was obtained when SUS 304 having the diameter of 0.225 mm was used. In FIG. 6, a tensile distance until a sample of 200 mm has ruptured is expressed as the elongation at break.

From FIG. 6, it is seen that as the compression rate increases, the rate of change in elongation at break decreases, and that the larger the compression rate is, the smaller the rate of change in elongation at break owing to the changed compression rate is.

Figure 7:
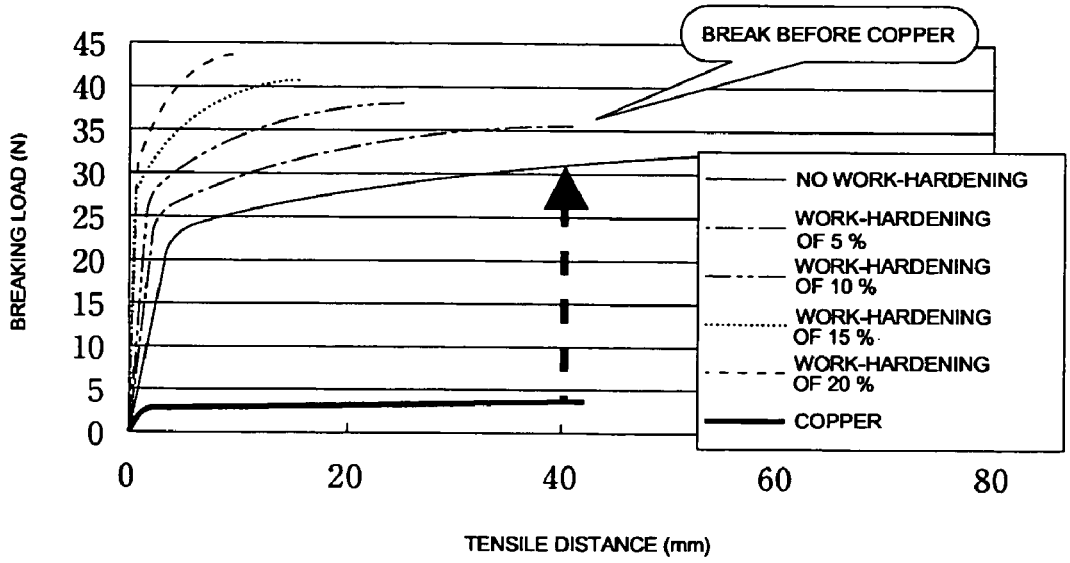
FIG. 7 is a graph which shows how a tensile distance relates to a breaking load as the compression rate of a stainless steel wire changes.

From this, how the breaking load of a stainless steel wire related to a tensile distance as the compression rate changed was found. FIG. 7 shows the result. In FIG. 7, the compression rate is expressed as a work-hardening rate. The tensile distance along the horizontal axis is a tensile distance measured on a sample of 200 mm.

From FIG. 7, it is seen that when the compression rate (work-hardening rate) is 5%, the stainless steel wire breaks as the tensile distance reaches 40 mm although copper used as peripheral element wires does not break. It is thus seen that at least when the compression rate is 5%, it is possible to prevent the problem of heat generation, i.e., the problem that the peripheral element wires break first while the central element wire alone remains unbroken and heat generates.

Next, an example of setting the compression rate to 20% or lower from a standpoint of impact breaking load will now be described.

First, a relationship between the breaking load of the conductor and a tensile distance was identified.

Figure 8:
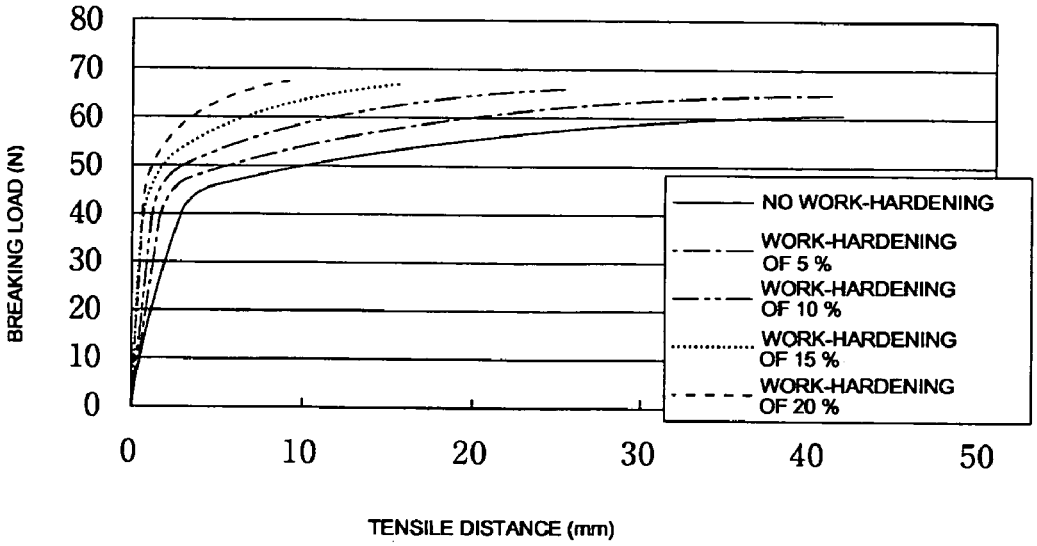
FIG. 8 is a graph which shows how a tensile distance relates to a breaking load as the compression rate of a conductor changes.

In the experiment, samples of a conductor having the same structure as that of the invention were fabricated using a stainless steel wire of SUS 304 having the diameter of 0.210 mm after compression as the central element wire and eight wires of pure copper having the diameter of 0.133 mm after compression as the peripheral element wires. The samples were hardened at work-hardening rates (compression rates) of 5%, 10%, 15% and 20%, and on thus hardened samples, the breaking loads of the conductors were measured under the condition that the chuck distance was 200 mm and the elastic stress rate was 100 mm/min. In this experiment, the measurements were taken on the assumption that breaking of the central element wires was breaking of the conductors. FIG. 8 shows the result.

Referring to the SS chart, the fracture energy was calculated based on the result shown in FIG. 8, and the impact breaking load was calculated with respect to this result. Table 2 shows the result.

TABLE 2

| Work-hardening rate (%) | Fracture energy (mj) | Impact breaking load (N) |
|---|---|---|
| 0 | 1091 | 18 |
| 5 | 1160 | 19 |
| 10 | 720 | 12 |
| 15 | 448 | 7 |
| 20 | 270 | 5 |

It is said that the impact breaking load needed in an electric wire for automobile is 5 N. Hence, it is seen from Table 2 that the requirement as for impact breaking load is met when the compression rate is at least 20% or lower.

EXAMPLE 3

SUS 304 having the cross sectional area of 0.0314 $mm^2$, and the tensile fracture strength of 957 MPa was used as a central element wire before compression. Pure copper having the cross sectional area of 0.1321 $mm^2$, and the tensile fracture strength of 240 MPa was used as peripheral element wires before compression. Seven such peripheral element wires were arranged in a single circle in tight adherence with each other around the central element wire. They were compressed at the compression rate of 10% using dies, thereby obtaining a conductor having the cross sectional area of 0.14 $mm^2$. Then, insulation coating was disposed by extrusion using a halogen-free material (olefin based) as a coating material, whereby the electric wire for automobile according to the invention was obtained. The tensile breaking load of thus fabricated electric wire was 68 N, the breaking load of the conductor was 59 N, and the impact breaking load was 11 N.

EXAMPLE 4

SUS 304 having the cross sectional area of 0.0398 $mm^2$, and the tensile fracture strength of 949 MPa was used as a central element wire before compression. Pure copper having the cross sectional area of 0.1231 $mm^2$, and the tensile fracture strength of 245 MPa was used as peripheral element wires before compression. Eight such peripheral element wires were arranged in a single circle in tight adherence with each other around the central element wire. They were compressed at the compression rate of 10% using dies, thereby obtaining a conductor having the cross sectional area of 0.14 $mm^2$. Then, insulation coating was disposed by extrusion using a halogen-free material (olefin based) as a coating material, whereby the electric wire for automobile according to the invention was obtained. The tensile breaking load of thus fabricated electric wire was 74 N, the breaking load of the conductor was 65 N, and the impact breaking load was 13 N.

The electric wire for automobile according to the invention satisfies the current demand for a smaller diameter and an improved tensile strength almost to a practical limit. The electric wire for automobile whose ratio C defined above is within the above range has satisfactory flexibility.

The electric wire for automobile whose compression rate defined above is within the above range can prevent the heat generation problem of the central element wire caused by breaking of the peripheral element wires before the central element wire breaks.

While the invention has been described in conjunction with exemplary embodiments, these embodiments should be viewed as illustrative, not limiting. Various modifications, substitutions, or the like are possible within the spirit and scope of the invention.

What is claimed is:

1. An electric wire for automobile comprising:

a compressed conductor including:

a single central element wire of stainless steel, and a plurality of peripheral element wires of copper or copper alloy disposed around the single central element wire in a single circle in tight adherence with each other, wherein a cross sectional area of the conductor is 0.10 through 0.30 $mm^2$, and a ratio C of a cross sectional area of the central element wire to the cross sectional area of the conductor expressed by $\{A/(A+B)\}\times 100(\%)$ equals 19.6 through 33.3%, wherein the symbol A denotes the cross sectional area of the central element wire and the symbol B denotes the total cross sectional area of the peripheral element wires.

2. The electric wire for automobile according to claim 1, wherein the cross sectional area of the conductor is 0.13 through 0.25 $mm^2$, and the ratio C of the cross sectional area of the central element wire to the cross sectional area of the conductor is 19.6 through 29.1%.

3. The electric wire for automobile according to claim 1, wherein the cross sectional area of the conductor is the nominal cross sectional area of 0.13 $mm^2$, the ratio C of the cross sectional area of the central element wire to the cross sectional area of the conductor is 24.5 through 29.1%, and the electric wire is used within a car room.

4. The electric wire for automobile according to claim 1, wherein the nominal cross sectional area of the conductor is 0.22 $mm^2$, the ratio C of the cross sectional area of the central element wire to the cross sectional area of the conductor is 24.5 through 29.1%, and the electric wire is used within an engine room.

5. An electric wire for automobile comprising:

a compressed conductor which is obtained by arranging, around a single central element wire of stainless steel, and seven or more peripheral element wires of copper or copper alloy in a single circle in tight adherence with each other, wherein a diameter of the central element wire is larger than diameters of the peripheral element wires, a cross sectional area of the conductor is 0.10 through 0.30 $mm^2$, and a compression rate from the cross sectional area of the conductor before compression to the cross sectional area of the conductor after compression is 5 through 20%.

6. The electric wire for automobile according to the claim 2, wherein the cross sectional area of the conductor is 0.13 through 0.25 $mm^2$.

7. The electric wire for automobile according to claim 2, wherein the nominal cross sectional area of the conductor is 0.13 $mm^2$, and the electric wire is used within a car room.

8. The electric wire for automobile according to claim 2, wherein the nominal cross sectional area of the conductor is 0.22 $mm^2$, and the electric wire is used within an engine room.

* * * * *